US011111051B2

(12) United States Patent
Hessburg

(10) Patent No.: US 11,111,051 B2
(45) Date of Patent: Sep. 7, 2021

(54) BOTTLE PACKAGING SYSTEM

(71) Applicant: Sip Better INC, Minneapolis, MN (US)

(72) Inventor: Anthony Todd Hessburg, Minnetrista, MN (US)

( * ) Notice: Subject to any disclaimer, the term of this patent is extended or adjusted under 35 U.S.C. 154(b) by 116 days.

(21) Appl. No.: 16/043,360

(22) Filed: Jul. 24, 2018

(65) Prior Publication Data

US 2019/0031390 A1 Jan. 31, 2019

Related U.S. Application Data

(60) Provisional application No. 62/536,567, filed on Jul. 25, 2017.

(51) Int. Cl.

| | |
|---|---|
| ***B65D 5/50*** | (2006.01) |
| ***B65D 5/02*** | (2006.01) |
| ***B65D 77/04*** | (2006.01) |
| ***B65D 5/66*** | (2006.01) |

(52) U.S. Cl.

CPC ..... *B65D 5/5007* (2013.01); *B65D 5/02* (2013.01); *B65D 5/6664* (2013.01); *B65D 77/0426* (2013.01)

(58) Field of Classification Search

CPC ..... B65D 5/02; B65D 5/0245; B65D 5/08; B65D 5/10; B65D 5/106; B65D 5/103; B65D 5/48; B65D 5/4801; B65D 5/48014; B65D 5/48018; B65D 5/50; B65D 5/5007; B65D 5/5009; B65D 5/5011; B65D 5/5021; B65D 77/0426; B65D 81/05; B65D 81/107; B65D 85/30; B65D 85/302; B65D 85/305; B65D 85/42

See application file for complete search history.

(56) References Cited

U.S. PATENT DOCUMENTS

| | | | | |
|---|---|---|---|---|
| 1,551,139 | A * | 8/1925 | Dietsche, Jr. | B65D 5/5023 206/763 |
| 2,678,724 | A * | 5/1954 | Andriot, Jr. | B65D 5/5495 206/393 |
| 2,749,019 | A * | 6/1956 | Ohlund | B65D 5/02 229/122 |
| 3,111,222 | A * | 11/1963 | Mueller, Jr. | B65D 5/5007 206/777 |
| D274,406 | S | 6/1984 | Hung | |
| D276,503 | S | 11/1984 | Mansau | |
| D311,331 | S | 10/1990 | Diba | |
| 5,116,290 | A | 5/1992 | Ross | |
| D368,656 | S | 4/1996 | Campbell-Scott | |
| 5,730,289 | A | 3/1998 | Cappels | |
| 5,967,320 | A | 10/1999 | Cappels | |
| D462,874 | S | 9/2002 | Simcox | |

(Continued)

FOREIGN PATENT DOCUMENTS

| | | |
|---|---|---|
| CH | 360646 | 8/1958 |
| EP | 2583906 | 10/2011 |

(Continued)

*Primary Examiner* — Mollie Impink

(74) *Attorney, Agent, or Firm* — Wallenfelt Law PLC

(57) ABSTRACT

A packaging for securely holding one or more bottles is provided with an upper support and a lower support that close parts of the packaging. In between the upper and the lower support are a plurality of neck tabs that are individually deformable to further limit mobility of the bottle in the packaging.

19 Claims, 6 Drawing Sheets

(56) References Cited

U.S. PATENT DOCUMENTS

| | | | | |
|---|---|---|---|---|
| D463,978 | S | 10/2002 | DiMartino | |
| D471,358 | S | 3/2003 | Yang | |
| D523,634 | S | 6/2006 | Dost | |
| D607,320 | S | 1/2010 | Tearle | |
| D668,948 | S | 10/2012 | LaTrobe | |
| 8,523,048 | B1 | 9/2013 | Spiegelman | |
| D710,693 | S | 8/2014 | Bhasin | |
| D747,960 | S | 1/2016 | Sculler | |
| D752,425 | S | 3/2016 | Parthenis, Jr. | |
| D756,562 | S | 5/2016 | Ghiotti | |
| 2017/0001793 | A1* | 1/2017 | Jiang | B65D 5/04 |
| 2017/0334596 | A1 | 11/2017 | Cruz | |

FOREIGN PATENT DOCUMENTS

| | | | | |
|---|---|---|---|---|
| EP | 2848546 | | 9/2013 | |
| EP | 2949588 | | 5/2014 | |
| FR | 1180563 | A * | 6/1959 | B65D 5/48 |
| FR | 2816916 | A1 * | 5/2002 | B65D 5/08 |
| GB | 965695 | | 5/1961 | |
| GB | 2344812 | | 12/1998 | |

* cited by examiner

BOTTLE PACKAGING SYSTEM

PRIORITY CLAIM

This application claims priority under 35 U.S.C. § 119(e) to U.S. Provisional Application Ser. No. 62/536,567, filed Jul. 25, 2017, each of which is expressly incorporated by reference herein.

BACKGROUND

The present disclosure relates to packaging, and in particular, to packaging for securely holding and shipping bottles. More particularly, the present disclosure relates to a packaging blank that adjustably forms a container to securely package glass bottles of various geometries.

Available packaging for glass bottles provides bulky one-size-fits-all shipping options. For example, inserts may be made of pre-formed blow molded or Styrofoam shells. These inserts are frequently not biodegradable. They provide exposure points for the bottles contained therein to contact other objects and break during transportation. They also provide stiff, non-conforming shells around bottles. Bottles of uniform volume, such as wine, spirits, and other beverage bottles, do not tend to be uniformly shaped. As a result the available inserts provide undesirable mobility of the bottles when shipped in the inserts. Further, such inserts take up a large amount of space when not being used to hold bottles. A need exists for packaging that provides protection for bottles that is customizable to a variety of shapes of glass bottles, sturdy enough for shipping, which stores easily when not holding bottles, and is environmentally friendly and cost effective.

SUMMARY

A packaging in accordance with the present disclosure is configured to hold a product, in particular a bottle, in an interior region formed in the packaging. In illustrative embodiments the packaging is preferable configured to hold two bottles in two interior regions formed in the packaging.

In one aspect, a packaging for securely holding one or more bottles comprises a bottle storage region having a back panel, a bottom panel, and three side panels that are configured so that a slot in one of the side panels mates with a slot receiver in the bottom panel, each side panel has a upper end and a lower end, a lower support has a lower locking tab formed at the lower end of two of the side panels which is configured to deform to secure the bottom panel in a closed position, and the packaging has means for closing a top end of the bottle storage region by securing the top end so as to provide a shock-absorbing region between the top end of the bottle and an exterior surface and to limit mobility of a bottle in the bottle storage region.

The means for securely closing the top end of the bottle storage region comprises a top flap extending from the back panel, an aperture in two of the side panels through which the top flap extends, and an upper locking tab formed in an upper end of the two side panels above the aperture, and the upper locking tab is deformed and positioned over a top surface of the top flap thereby preventing the top flap from opening.

The packaging includes a plurality of neck tabs, each individually deformable into the product storage region to limit mobility of a bottle inside the product storage region.

The upper locking tab forms an upper boundary of the aperture and one of the plurality of neck tabs forms a lower boundary of the aperture.

In one aspect, the packaging is a blank configured to be stored and transported in a flat configuration when not in use.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

DETAILED DESCRIPTION

Figure 1:
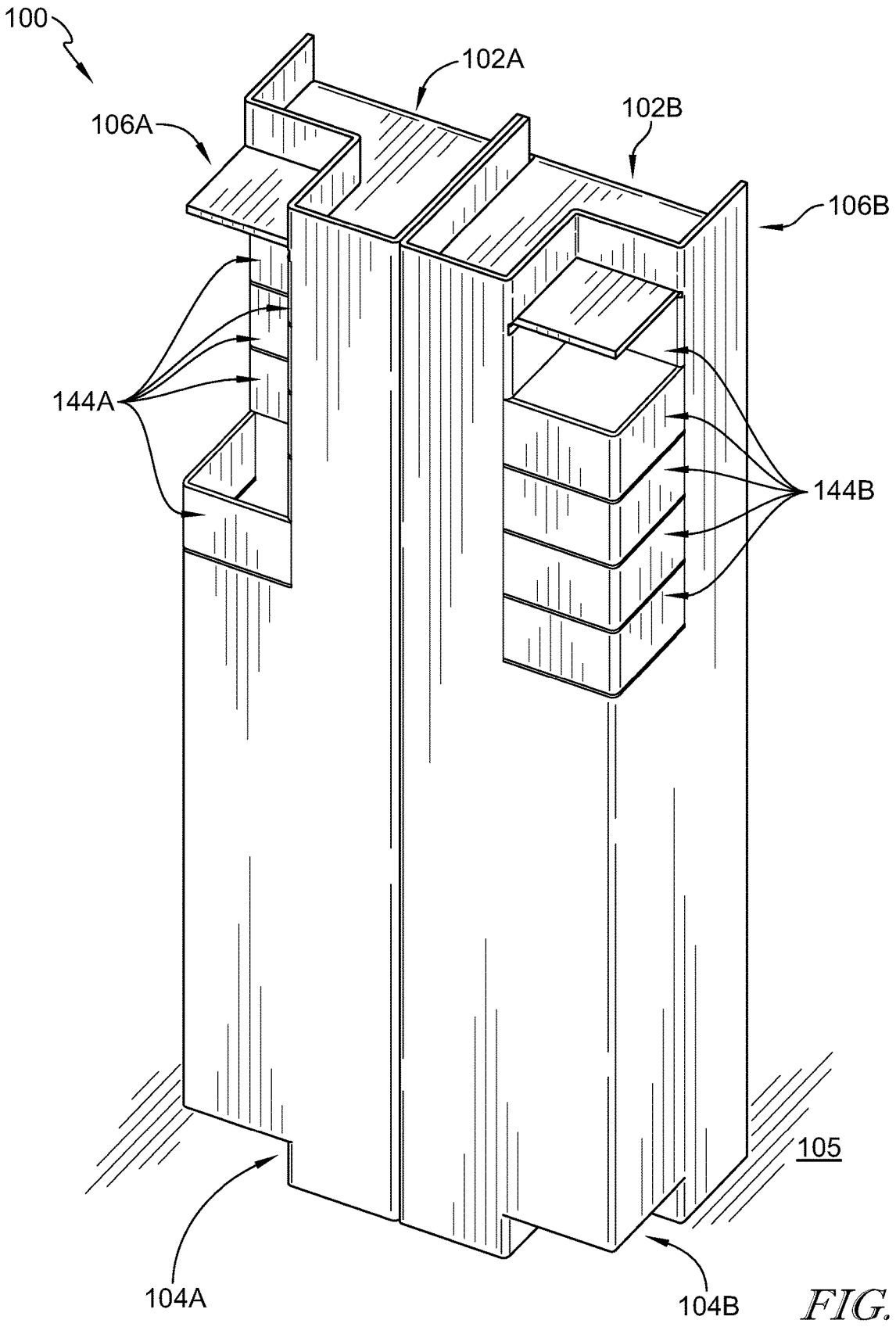
FIG. 1 is perspective view of a packaging in accordance with the present disclosure made from a blank as suggested in FIG. 2.

An embodiment of the presently disclosed packaging 100 for securely packaging bottles, in particular glass bottles such as wine bottles, is shown in FIG. 1. The packaging may include two bottle storage regions 102A, 102B. Each bottle storage region 102A, 102B, may include a bottom support 104A, 104B configured to support a bottle in an upright position in spaced apart relation to an exterior lower surface 105. Each bottle storage region 102A, 102B may also include a top support 106A, 106B configured to support a bottle in spaced apart relation to an exterior upper surface. Each bottle storage region 102A, 102B may further include a plurality of neck tabs 144A, 144B in an upper half of the side panels configured to be selectively deformed into the interior of each bottle storage region 102A, 102B to contact and secure the particular geometry of a bottle placed within each bottle storage region 102A, 102B. For example, as seen in FIG. 1, bottle storage region 102B may store a tall bottle with a short neck so that only the uppermost neck tab 144B may be depressed. In the same example, bottle storage region 102A may store a shorter bottle, or a bottle with a longer neck so that the four uppermost neck tabs 144A may be depressed into the region. In this manner, neck tabs 144A, 144B may be selected and deformed to prevent upward mobility of each particular bottle geometry. In some examples, the same number of neck tabs may be selected and deformed in each bottle storage region 102A, 102B so that the bottle storage regions 102A, 102B are symmetrical about a vertical axis between them. Each bottle storage region 102A, 102B may be completely enclosed, aside from any gaps that may be formed resulting from the deformed neck tabs, thereby minimizing exposure of bottles to the exterior environment or contact breakage.

Figure 2:
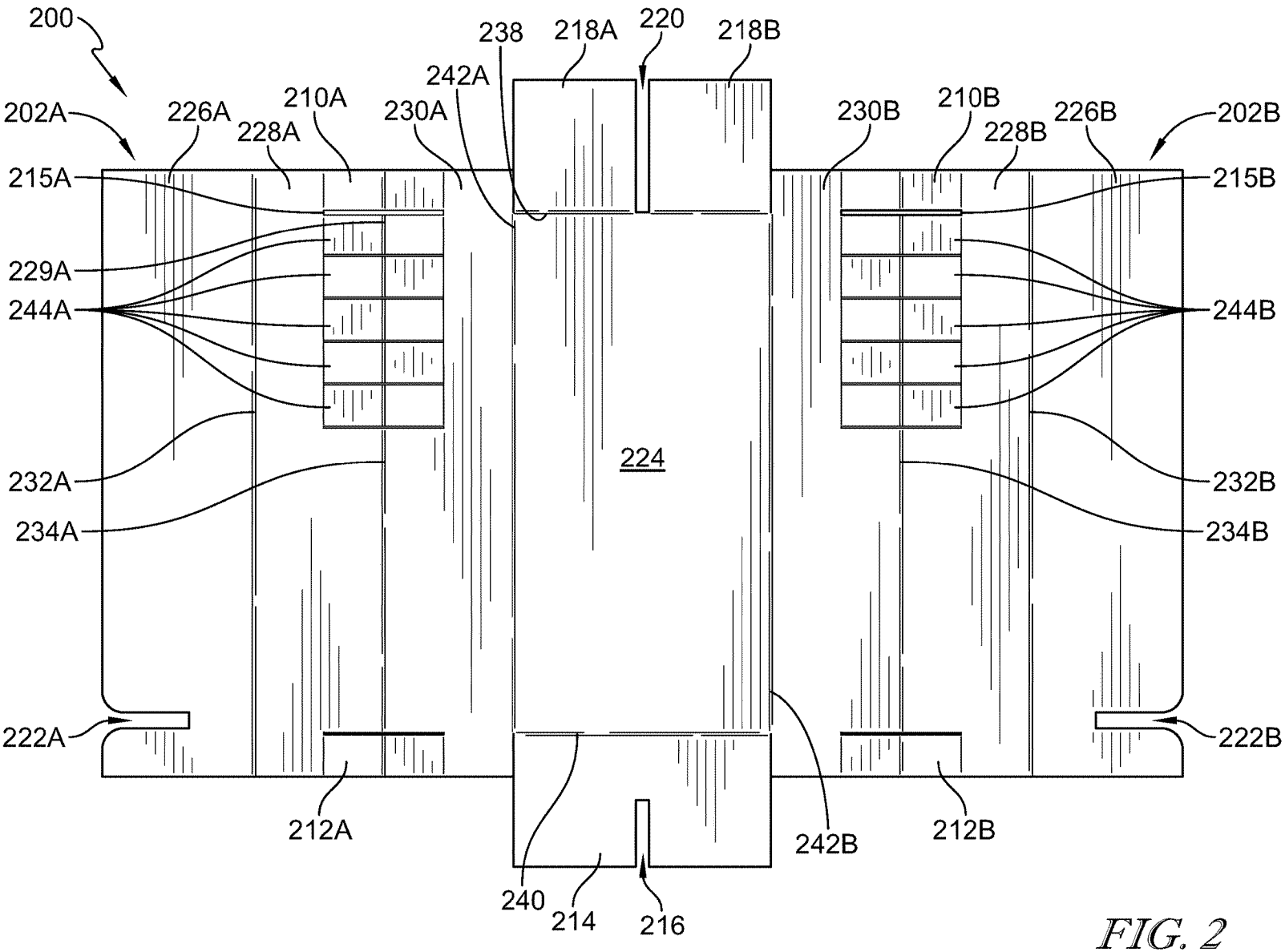
FIG. 2 is a plan view of a blank used to form the packaging of FIG. 1.

Packaging blank 200, as seen in FIG. 2, may be a flat, monolithic structure that includes a plurality of panels 226A, 228A, 230A foldable to form the walls of bottle storage region 202A. Packaging blank 200 includes a plurality of panels 226B, 228B, 230B foldable to form bottle storage region 202B. Panels 226A, 228A, 230A, 226B, 228B, 230B are foldable towards back panel 224. As the blank portions that form bottle storage region 202A are a mirror image of the blank portions that form bottle storage region 202B, the Figure will be described with respect to storage region 202A. Corresponding components that form 202B are understood to be the same unless otherwise indicated. Panels 226A, 228A, 230A are separated by fold lines 232A, 234A that may be formed by scoring bending, or otherwise reducing thickness of the packaging along the fold lines 232A, 234A. Outermost panels 226A, 228B each include a sidewall slot 222A, 222B, spaced apart from and parallel to the bottom of the sidewall panels. Sidewall slot 222A, 222B extends from the edge approximately to the midpoint of panel 226A, 226B.

Panels 228A and 230A may include a plurality of neck tabs 244A that are cut strips in the blank that span longitudinally across the panels 228A 230A so that a deformable midpoints 229A coincide with fold line 234A. Each neck tab 244A is a strip segment of the panel configured to be individually and adjustably projected into the bottle storage region 202A by applying a force to the neck tab 244A to deform the neck tab 244A forming an inverted "L"-shape, thereby restricting mobility of a bottle placed in the region 202A. In the exemplary embodiment, there are five neck tabs 244A on each side of the back panel 224. However, more or fewer neck tabs may be employed. The neck tabs may take on a variety of different shapes, and may be shorter, longer, thicker or thinner to alter the deformation of the tab and accommodate a variety of bottle geometries.

Panels 228A 228B may further include upper locking tab 210A, 210B and lower locking tab 212A, 212B. Each of the upper locking tab 210A and lower locking tab 212A are strip segments located at the edges of the panel configured to deform inwardly to form an inverted "L"-shape when external pressure is applied to the respective locking tab. Upper locking tabs 210A, 210B, cooperate with neck tabs 244A, 244B to define the boundaries of apertures 215A, 215B. Apertures 215A, 215B may be larger than any minimal spacing that exists between the strips tabs 244A in their undeformed state. Locking tabs 210A, 212A, are configured to cooperate with bottom wall 214 and a top wall 218A to form top and lower supports as will be described in greater detail below.

The common back panel 224 may form the back panel of each bottle storage region 202A 202B. Back panel includes side fold lines 242A, 242B, and upper and lower fold lines 238, 240. Lower fold line 240 forms bottom wall 214. Bottom wall 214 includes a sidewall slot receiver 216. Sidewall slot receiver 216 is a slot that may extend from an edge of the bottom wall 214 approximately halfway toward the fold line 240. Sidewall slot receiver 216 is configured to receive sidewall slots 222A, 222B. By maintaining the bottom wall 214 as a unitary piece, the wall 214 may provide additional structural support when one or more bottles are loaded in the resulting package. Upper fold line 238 forms top wall flaps 218A, 218B, divided by sidewall receiver 220 that extends from outer ends of the top wall flaps 218A, 218B to the fold line 238. Sidewall receiver 220 is configured to receive panels 226A, 226B.

Figure 3:
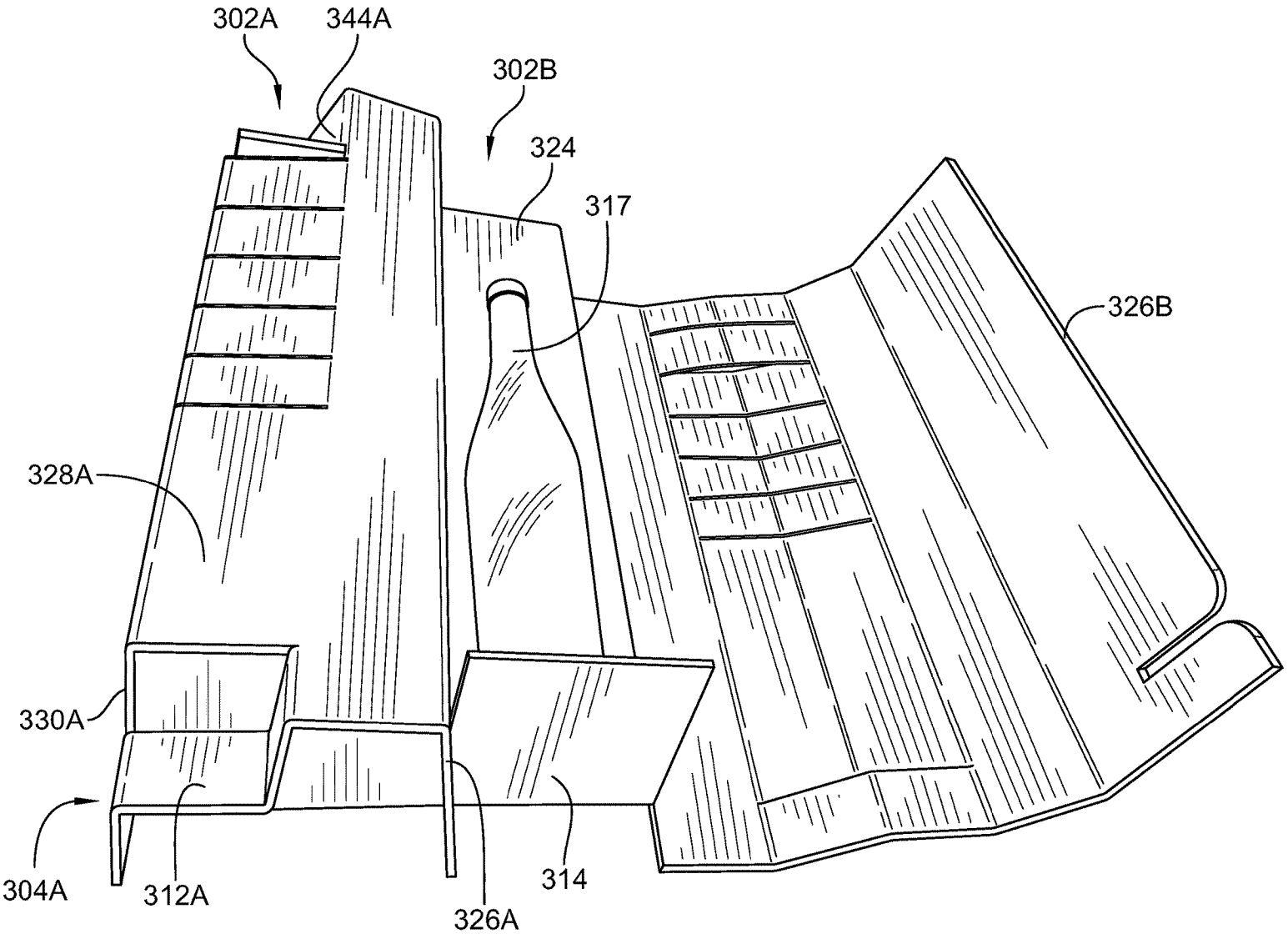
FIG. 3 is a plan view of a partial assembly of the blank defining an interior region to hold a bottle.

As illustrated in FIG. 3, when a bottle is loaded into bottle storage region 302A, bottom wall 314 is folded along its fold line, and panels 326A, 328A, 330A are each folded inward toward back panel 324 so that panel 326A contacts back panel 324 at approximately a midpoint of the back panel 324. Panels 326A, 328A, 330A may be dimensioned to lie in close proximity to, or contact the largest diameter of a bottle placed therein. Sidewall slot 322A may engage sidewall slot receiver 316. Inward pressure may be applied to a corner formed in the panels 328A, 330A, to deform and enable locking of the lower locking tab 312A beneath and in contact with a surface of the bottom wall 314. The combination of the lower locking tab 312A and the bottom wall 314 form a first lower support 304A. One or more neck tabs 344A may be deformed individually by applying pressure at deformable midpoints 329A to contact and/or prevent mobility of the bottle in a sloped neck region of a bottle. In some embodiments, only the lowest-most-tab 344A that can be depressed inwardly towards the bottle neck will be deformed. In other embodiments, the lower-most-tab and each tab above it that may be deformed will be deformed (as shown in FIG. 1) to provide greater strength in resistance to upward movement, by reinforcing the lower-most tab. This configuration additionally provides safety mechanism against full movement of the bottle, should one or more deformed neck tabs 344A fail to remain deformed during shipment as the other deformed neck tabs will still limit movement. A second bottle 317, for example a 750 mL wine bottle, may be placed on back panel 324 around which the second bottle storage region 302B may be formed in similar fashion. Panel 326B contacts back panel 324 and panel 326A so that bottle 317 is separated from a bottle in the first bottle storage region 302A by both panels 326A, 326B.

Figure 4A:
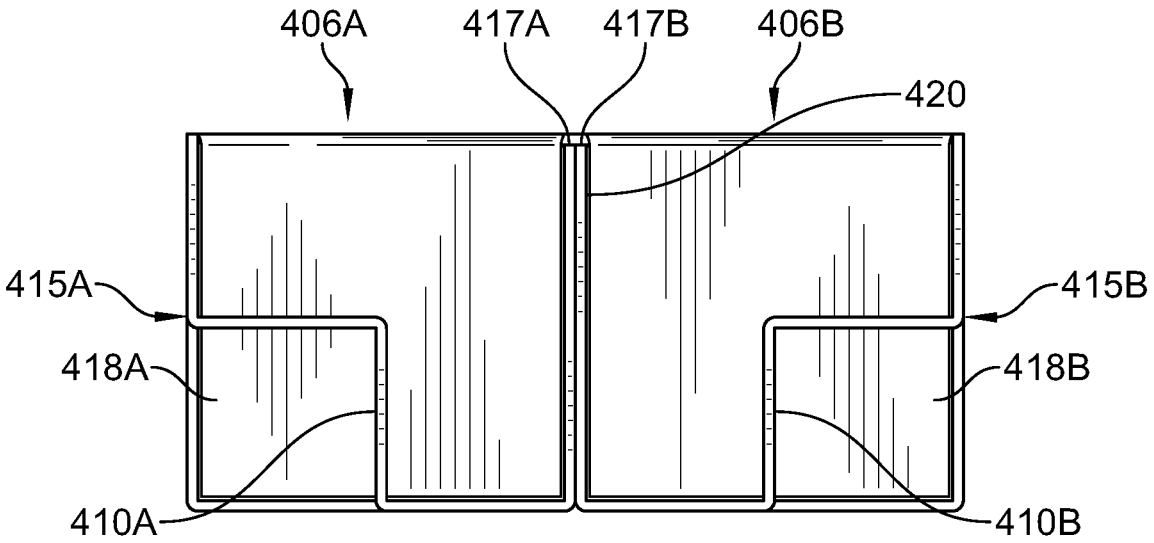
FIG. 4A is a top view of a top support of the packaging of FIG. 1.

Top support 406A, 406B, as illustrated in FIG. 4A includes top wall flaps 418A, 418B, each securely folded towards the interior of a bottle storage region, extending through apertures 415A, 415B, and secured by upper locking tabs 410A, 410B, which deform and extend inwardly from respective sidewall panels. Sidewall panels 426A, 426B may contact each other and contact the back panel via slot 420. Top wall flaps 418A, 418B may cooperate with upper locking tabs 410A, 410B to prevent one or more bottles within the packaging from exiting the top of the packaging.

Figure 4B:
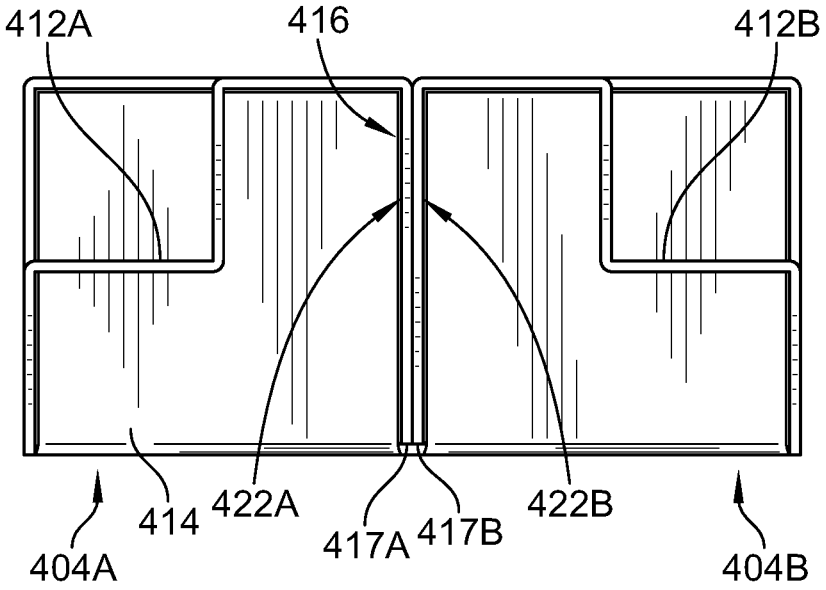
FIG. 4B is a bottom view of a bottom support of the packaging of FIG. 1.

Bottom supports 104A, 104B, as illustrated in FIG. 4B includes a unitary bottom wall 414, securely folded towards the interior of the bottle storage regions by lower locking tabs 412A, 412B. Sidewall slots 422A, 422B slide into and mate with receiver slot 416. Thereby, tabs 417A, 417B along with lower locking tabs 412A, 412B may form a stable base on which the packaging can stand on end, so that the bottom wall is 414 is elevated and parallel to a supporting surface.

Figure 5:
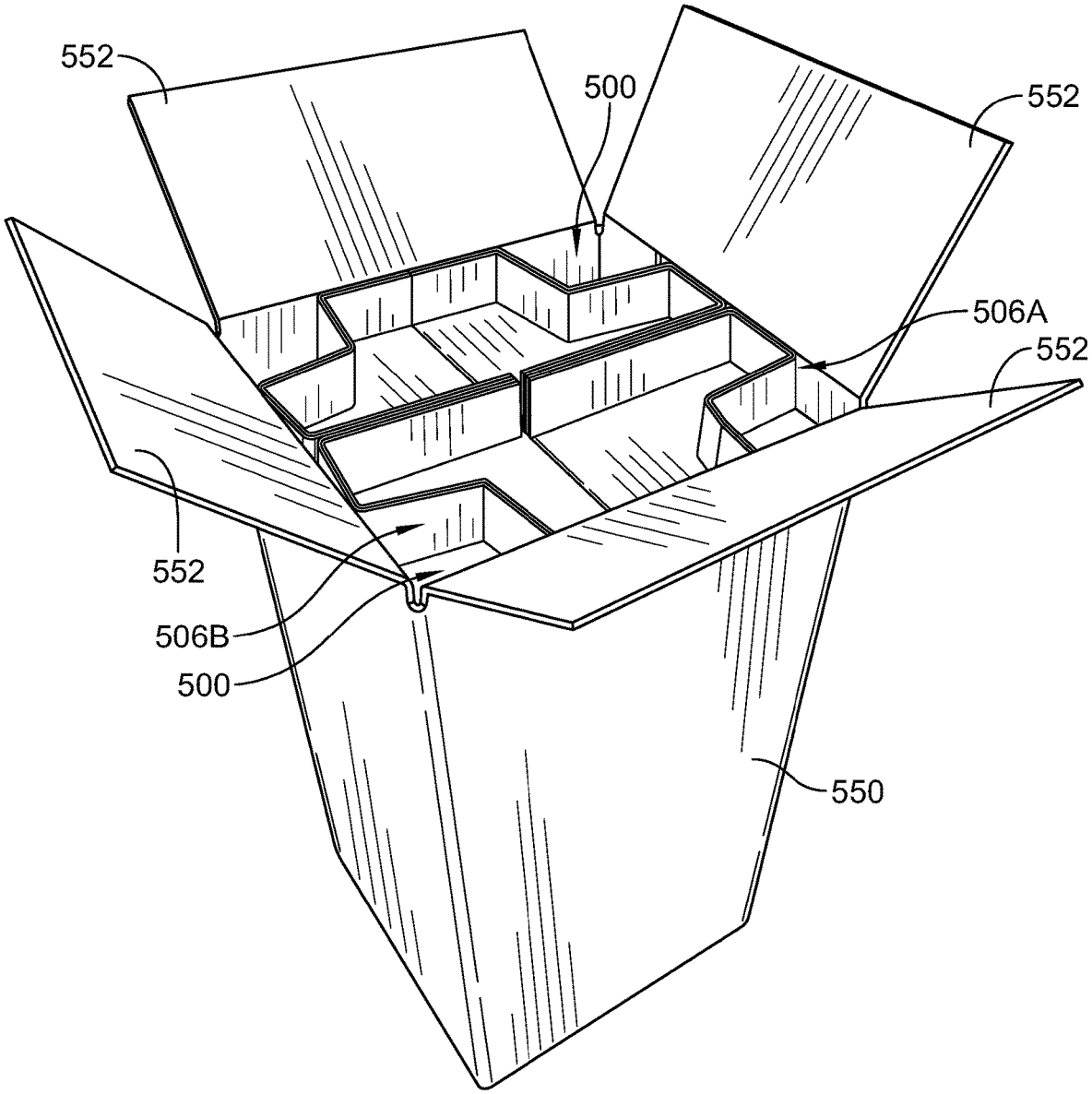
FIG. 5 is a view of a top-load packaging system using the packaging of FIG. 1.

As can be seen in FIG. 5, a top-load packaging system may include a plurality of packaging devices 500 into container 550 that may be used for shipment. In the illustrative embodiment. The illustrative container 550, is configured to securely accommodate two packaging devices 500 in a parallel vertical arrangement so that each packaging device will be in contact with the adjacent packaging device and in contact with the sidewalls of the container 550 via an interference fit. The container 550 may be dimensioned so that ends of the top supports 506A, 506B are approximately in a parallel plane to the top of the sidewalls of the container so that when top flaps 552 of the box are secured closed, the top supports 506A, 506B contact the top flaps 552 to define shock absorbing top region. Likewise, bottom supports 512A, 4512B (not visible) may contact the bottom of the container 550 to define a shock absorbing bottom region. In this manner, bottles in the container are immobilized relative to the container 550. Containers similar to the illustrative container may be dimensioned to securely hold and ship other numbers of packaging devices, such as two, six, or eight. Similar containers may be dimensioned to be twice as wide to stack one row adjacent to another row (for example, one row of six packaging devices stacked adjacent another row of six packaging devices). Containers may also be sized to permit additional packing and/or insulating materials to be placed in the container and around the packaging devices.

Figure 6:
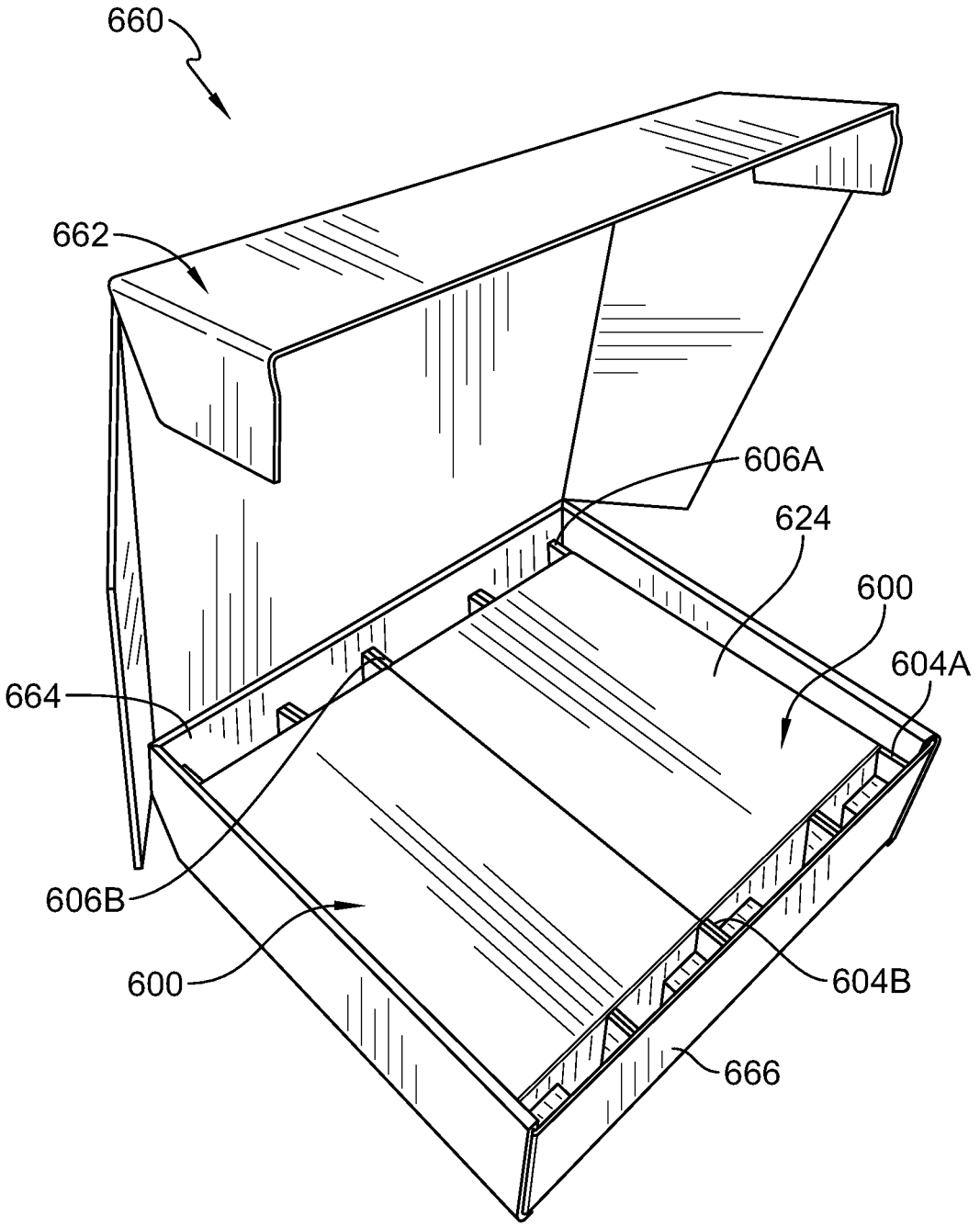
FIG. 6 is a view of a side-load packaging system using the packaging of FIG. 1.

As seen in FIG. 6, a side-load packaging system may include a plurality of packaging devices 600 in a container 660 that may be used for shipment. The illustrative container 660 is configured to securely accommodate two packaging devices in a horizontal side-by-side relationship so that all of the bottles may lie in the same horizontal plane and so that each packaging device will be in contact with the adjacent packaging device via, and in contact with sidewalls of the container via an interference fit. In the illustrative embodiment, packaging device 600 is inserted so that the back of the back panel 624 is exposed when the container lid 662 is open. However, the packaging device may also be inserted so that sidewall panels are exposed when the container lid 662 is open. The container 660 may be dimensioned so that the ends of the top support 606A, 606B form an interference fit with sidewall 664 of container 660, and so that ends of the bottom supports 612A, 612B are in an interference fit with the sidewall 666, thereby defining shock absorbing top and bottom regions. In this manner, bottles in the container are immobilized relative to the container 660. Containers similar to the illustrative container may be dimensioned to securely hold and ship other numbers of packaging devices, or may be sized to stack numbers of packaging devices on top of each other horizontally. Containers may also be sized to permit additional packing and/or insulating materials to be placed in the container and around the packaging devices.

The packaging provides flexible customization of the bottle storage region to securely store and ship bottles, specifically glass bottles, of various geometries avoiding breakage. In the illustrative embodiments, single-ply corrugated cardboard may be used for packaging and containers. However, it is envisioned that double-layer corrugated cardboard may be used for additional protection. Other biodegradable or recycled materials including cardboard, paper, or newspaper materials may be used, as well, as flexible polymeric materials.

1. A packaging for securely holding one or more bottles comprising:

a bottle storage region having a back panel, a bottom panel, and three side panels that are configured so that a slot in one of the side panels mates with a slot receiver in the bottom panel, each side panel having a upper end and a lower end, a lower support having a lower locking tab formed at the lower end of two of the side panels which is configured to deform to secure the bottom panel in a closed position, and means for closing a top end of the bottle storage region by securing the top end so as to provide a shock-absorbing region between the top end of the bottle and an exterior surface and to limit mobility of a bottle in the bottle storage region.

2. The packaging of claim 1, wherein the means for securely closing the top end of the bottle storage region comprises a top flap extending from the back panel, an aperture in two of the side panels through which the top flap extends, and an upper locking tab formed in an upper end of the two side panels above the aperture, wherein the upper locking tab is deformed and positioned over a top surface of the top flap thereby preventing the top flap from opening.

3. The packaging of claim 2, further comprising a plurality of neck tabs, wherein the neck tabs are each individually deformable into the product storage region to limit mobility of a bottle inside the product storage region.

4. The packaging of claim 3, wherein the upper locking tab forms an upper boundary of the aperture and one of the plurality of neck tabs forms a lower boundary of the aperture.

5. The packaging of claim 1, wherein the lower support further includes a tab extending beneath the slot in the side panel, wherein the tab and the lower locking tab form a stable base for the packaging to support the bottom panel in spaced-apart relation to an exterior surface when the packaging is in an upright position on the exterior surface.

6. The packaging of claim 5, further comprising a plurality of neck tabs, wherein the neck tabs are each individually deformable into the product storage region to limit mobility of a bottle inside the product storage region, wherein one of the plurality of neck tabs contacts the means for closing.

7. The packaging of claim 2, further comprising a second bottle storage region having a second set of side panels located on an opposite side of the back panel from the three side panels, wherein the second bottle storage region is symmetrical to the first bottle storage region along a vertical axis.

8. The packaging of claim 9, wherein the second bottle storage region has a second top flap extending from the back panel, wherein the second top flap is separated from the top flap of the first bottle storage region by a sidewall receiver so that each of the top flap and the second top flap are independently moveable about the back panel.

9. The packaging of claim 1, further comprising a second bottle storage region having a second set of side panels located on an opposite side of the back panel from the three side panels, wherein the second bottle storage region is symmetrical to the first bottle storage region along a vertical axis.

10. The packaging of claim 9, wherein the slot receiver of the bottom panel extends from an end of the bottom panel into a mid-region of the bottom panel so that the bottom panel supports a bottle in each of the first and second bottle storage regions.

11. A packaging for securely holding one or more bottles comprising:

a bottle storage region having a back panel, a bottom panel, and three side panels that are configured so that a slot in one of the side panels mates with a slot receiver extending partway into the bottom panel, each side panel having a upper end and a lower end, a lower support having a lower locking tab formed at the lower end of two of the side panels which is configured to deform and secure the bottom panel in a closed position, and an upper support having an upper locking tab formed at the upper end of the two side panels, a top panel extending from the back panel, and an aperture located in the two side panels, wherein the upper locking tab is configured to deform and secure the top panel in a closed position so that the top panel extends into the aperture.

12. The packaging of claim 11, further comprising a second bottle storage region having a second set of side panels located on an opposite side of the back panel from the three side panels.

13. The packaging of claim 12, wherein the second set of side panels includes a second slot, and the bottom panel slot receiver is coupled to the slot of the first bottle storage region and the slot of the second storage region.

14. The packaging of claim 13, wherein the second bottle storage region has a second lower support having a second deformable lower locking tab which cooperates with the lower locking tab to secure the bottom panel in the closed position, and wherein the tabs and lower locking tabs form a stable base for the packaging to support the bottom panel in spaced-apart relation to an exterior surface when the packaging is in an upright position on the exterior surface.

15. The packaging of claim 12, wherein each bottle storage region comprises a plurality of neck tabs, wherein the neck tabs are each individually deformable into the product storage region to limit mobility of a bottle inside the product storage region.

16. The packaging of claim 15, wherein the second bottle storage region comprises a second upper support having a second upper locking tab, top flap, and aperture, wherein the upper locking tab of each bottle storage region forms an upper boundary of each aperture and each plurality of neck tabs forms a lower boundary of each aperture.

17. The packaging of claim 16, wherein the second top flap is separated from the top flap of the first bottle storage region by a sidewall receiver so that each of the top flap and the second top flap are independently moveable about the back panel.

18. The packaging of claim 12, wherein the bottle storage region and the second bottle storage region are symmetrical about a vertical axis and configured to store two bottles on one side of the back panel.

19. The packaging of claim 11, further comprising a plurality of neck tabs, wherein the neck tabs are each individually deformable into the product storage region to limit mobility of a bottle inside the product storage region.

20. The packaging of claim 18, wherein the upper locking tab forms an upper boundary of the aperture and one of the plurality of neck tabs forms a lower boundary of the aperture.

The invention claimed is:

1. A packaging for securely holding one or more bottles comprising:

a first bottle storage region having a back panel, a bottom panel, and three side panels that are configured so that a slot in one of the side panels mates with a slot receiver in the bottom panel, each side panel having an upper end and a lower end, a lower support having a lower locking tab formed at the lower end of two of the side panels which is configured to deform to secure the bottom panel in a closed position, means for closing a top end of the first bottle storage region so as to provide a shock-absorbing region between the top end of the first bottle storage region and an exterior surface and to limit mobility of a bottle in the first bottle storage region, and a plurality of neck tabs that each include a strip that extends longitudinally across a portion of a first side panel of the three side panels and a portion of a second side panel of the three side panels, the first side panel being adjacent to the second side panel, the portion of the first side panel being less than the width of the first side panel and the portion of the second side panel being less than the width of the second side panel, wherein the plurality of neck tabs are sized and positioned to be deformed individually to contact and prevent mobility of a sloped neck region of a bottle disposed within the first bottle storage region.

2. The packaging of claim 1, wherein the means for securely closing the top end of the first bottle storage region comprises a top flap extending from the back panel, an aperture in two of the side panels through which the top flap extends, and an upper locking tab formed in an upper end of the two side panels above the aperture, wherein the upper locking tab is deformed and positioned over a top surface of the top flap thereby preventing the top flap from opening.

3. The packaging of claim 2, wherein the neck tabs are each individually deformable into the first bottle storage region to limit mobility of a bottle inside the first bottle storage region.

4. The packaging of claim 3, wherein the upper locking tab forms an upper boundary of the aperture and one of the plurality of neck tabs forms a lower boundary of the aperture.

5. The packaging of claim 1, wherein the lower support further includes a tab extending beneath the slot in the side panel, wherein the tab and the lower locking tab form a stable base for the packaging to support the bottom panel in spaced-apart relation to an exterior surface when the packaging is in an upright position on the exterior surface.

6. The packaging of claim 5, wherein the neck tabs are each individually deformable into the first bottle storage region to limit mobility of a bottle inside the first bottle storage region, wherein one of the plurality of neck tabs contacts the means for closing.

7. The packaging of claim 1, further comprising a second bottle storage region having a second set of side panels located on an opposite side of the back panel from the three side panels, wherein the second bottle storage region is symmetrical to the first bottle storage region along a vertical axis.

8. The packaging of claim 7, wherein the second bottle storage region has a second top flap extending from the back panel, wherein the second top flap is separated from the top flap of the first bottle storage region by a sidewall receiver so that each of the top flap and the second top flap are independently moveable about the back panel.

9. The packaging of claim 8, wherein the slot receiver of the bottom panel extends from an end of the bottom panel into a mid-region of the bottom panel so that the bottom panel supports a bottle in each of the first and second bottle storage regions.

10. A packaging for securely holding one or more bottles comprising:

a back panel, a bottom panel, and a top panel extending from the back panel, a first bottle storage region formed from the back panel, the bottom panel, and a first set of three side panels that are configured so that a slot in one of the side panels mates with a slot receiver extending partway into the bottom panel, each side panel having an upper end and a lower end, a second bottle storage region formed from the back panel, the bottom panel, and a second set of three side panels that are located on an opposite side of the back panel from the first set of three side panels and are configured so that a slot in one of the side panels mates with the slot receiver of the bottom panel, wherein the slot receiver of the bottom panel is wide enough to accommodate the thickness of two panels, a lower support having a lower locking tab formed at the lower end of two side panels of the first set of three side panels which is configured to deform and secure the bottom panel in a closed position, and an upper support having an upper locking tab formed at the upper end of the two side panels of the first set of three side panels, and an aperture located in the two side panels of the first set of three side panels, wherein the upper locking tab is configured to deform and secure the top panel in a closed position so that the top panel extends into the aperture.

11. The packaging of claim 10, wherein the bottom panel slot receiver is coupled to the slot of the first bottle storage region and the slot of the second storage region.

12. The packaging of claim 11, wherein the second bottle storage region has a second lower support having a second deformable lower locking tab which cooperates with the lower locking tab to secure the bottom panel in the closed position, and wherein the lower locking tab and second lower locking tab form a stable base for the packaging to support the bottom panel in spaced-apart relation to an exterior surface when the packaging is in an upright position on the exterior surface.

13. The packaging of claim 11, wherein each bottle storage region comprises a plurality of neck tabs, wherein the neck tabs are each individually deformable into the bottle storage region to limit mobility of a bottle inside the bottle storage region.

14. The packaging of claim 13, wherein the second bottle storage region comprises a second upper support having a second upper locking tab, top flap, and aperture, wherein the upper locking tab of each bottle storage region forms an upper boundary of each aperture and each plurality of neck tabs forms a lower boundary of each aperture.

15. The packaging of claim 14, wherein the second top flap is separated from the top flap of the first bottle storage region by a sidewall receiver so that each of the top flap and the second top flap are independently moveable about the back panel.

16. A packaging for securely holding one or more bottles comprising:

an exterior container; and an interior container formed from a foldable flat blank and configured to fit within the exterior container, the interior container including:

a back panel and a bottom panel;

a first bottle storage region formed from the back panel, the bottom panel, and a first set of three side panels that are configured so that a first slot in one of the side panels mates with a slot receiver extending into the bottom panel;

a second bottle storage region formed from the back panel, the bottom panel, and a second set of three side panels that are located on an opposite side of the back panel from the first set of three side panels and are configured so that a first slot in one of the side panels mates with the slot receiver of the bottom panel, wherein the slot receiver of the bottom panel is a slot extending into the bottom panel and is wide enough to accommodate twice the thickness of the foldable flat blank; and a plurality of neck tabs that extend longitudinally across a portion of a first side panel of the first set of three side panels and a portion of a second side panel of the first set of three side panels, the first side panel being adjacent to the second side panel, the portion of the first side panel being less than the entire width of the first side panel and the portion of the second side panel being less than the entire width of the second side panel.

17. The packaging of claim 16, wherein the neck tabs are configured to, when fully deformed, form an inverted "L"-shape within the first bottle storage region.

18. The packaging of claim 16, wherein the neck tabs are configured to be selectively deformed into the interior of the first bottle storage region to contact a neck of a bottle placed within the first bottle storage region and restrict mobility of the bottle.

19. The packaging of claim 16, further comprising a top panel that extends from the back panel and includes a slot receiver that is configured to mate with a second slot in the one of the side panels of the first bottle storage region and a second slot in the one of the side panels of the second bottle storage region, wherein the slot receiver is a slot extending into the top panel and is wide enough to accommodate twice the thickness of the foldable flat blank.

* * * * *